US006074436A

United States Patent [19]

Wang et al.

[11] Patent Number: 6,074,436

[45] **Date of Patent: *Jun. 13, 2000**

[54] CARPET TREATMENT COMPOSITION COMPRISING POLYCARBOXYLATE SALTS

[75] Inventors: Shou-Lu G. Wang, Woodbury; Irvin F. Dunsmore, Ham Lake; Robert F. Kamrath, Mahtomedi; John C. Chang, New Brighton, all of Minn.

[73] Assignee: 3M Innovative Properties Company, St. Paul, Minn.

[ * ] Notice: This patent is subject to a terminal disclaimer.

[21] Appl. No.: 09/076,996

[22] Filed: May 13, 1998

Related U.S. Application Data

[63] Continuation of application No. 08/685,327, Jul. 23, 1996, Pat. No. 5,756,181.

[51] Int. Cl.[7] ..... D06M 13/325; D06M 15/19

[52] U.S. Cl. ..... 8/15.62; 8/15.64; 8/15.6; 427/393.4; 427/394

[58] Field of Search ..... 8/115.62, 115.64, 8/115.6; 427/393.4, 394

[56] References Cited

U.S. PATENT DOCUMENTS

| | | |
|---|---|---|
| 3,388,106 | 6/1968 | Muskat . |
| 3,398,182 | 8/1968 | Guenthner et al. . |
| 3,398,192 | 8/1968 | Tarnow et al. . |
| 3,779,929 | 12/1973 | Abler et al. . |
| 3,835,071 | 9/1974 | Allen et al. . |
| 3,923,715 | 12/1975 | Dettre et al. . |
| 4,001,305 | 1/1977 | Dear et al. . |
| 4,029,585 | 6/1977 | Dettre et al. . |
| 4,068,026 | 1/1978 | Wagner . |
| 4,205,112 | 5/1980 | Mervin . |
| 4,264,484 | 4/1981 | Patel . |
| 4,542,044 | 9/1985 | Gano et al. . |
| 4,792,354 | 12/1988 | Matsuo et al. . |
| 4,937,123 | 6/1990 | Chang et al. . |
| 5,001,004 | 3/1991 | Fitzgerald et al. . |
| 5,074,883 | 12/1991 | Wang . |
| 5,212,272 | 5/1993 | Sargent et al. . |
| 5,252,232 | 10/1993 | Vinod . |
| 5,346,726 | 9/1994 | Pechhold . |
| 5,370,919 | 12/1994 | Fieuws et al. . |
| 5,401,554 | 3/1995 | Armen . |
| 5,410,073 | 4/1995 | Kirchner . |
| 5,436,049 | 7/1995 | Hu . |
| 5,460,887 | 10/1995 | Pechhold . |
| 5,738,687 | 4/1998 | Kamrath et al. . |
| 5,756,181 | 5/1998 | Wang et al. . |

FOREIGN PATENT DOCUMENTS

| | | | |
|---|---|---|---|
| 0 725 183 | 8/1996 | European Pat. Off. | D06M 13/224 |
| WO 93/01348 | 1/1993 | WIPO | D06M 15/277 |
| WO 96/386622 | 12/1996 | WIPO | D06M 15/576 |

OTHER PUBLICATIONS

Mason Hayek, *Waterproofing and Water/Oil Repellency*, 24, Kirk–Othmer Encyclopedia of Chemical Technology, pp. 448–455 (3d ed. 1979).

*Dyes, Application and Evaluation*, 8, Kirk–Othmer Encyclopedia of Chemical Technology, pp. 686–703 (3d ed. 1979).

N. Nevrekar, B. Palan, "Spin Finishes for Synthetic Fibres—Part IV", *Man–Made Textiles In India*, pp. 331–336 (Sept. 1991).

P. Bajaj, R, Katre, "Spin Finishes", *Colourage*, pp. 17–26 (Nov. 16–30, 1987).

W. Postman, "Spin Finishes Explained", *Textile Research Journal*, vol. 50, No. 7, pp. 444–453 (Jul. 1980).

*Primary Examiner*—Margaret Einsmann

*Attorney, Agent, or Firm*—Kent S. Kokko, Ph.D

[57] ABSTRACT

A method for imparting soil resistance to unscoured carpets, and a carpet treated in accordance with the method, are provided. In accordance with the method, a substrate comprising unscoured carpet fibers is treated with a salt of a polycarboxylic acid. The treated substrate is found to have enhanced water and oil repellency in both heat cured and room temperature drying conditions.

57 Claims, No Drawings

CARPET TREATMENT COMPOSITION COMPRISING POLYCARBOXYLATE SALTS

RELATED APPLICATIONS

This application is a continuation of U.S. Pat. No. 5,756,181, which is incorporated herein by reference.

FIELD OF THE INVENTION

The present invention relates generally to repellent, soil resistant carpets, and in particular to a method and apparatus for imparting soil resistance and/or repellency to carpets using polycarboxylate salts.

BACKGROUND OF THE INVENTION

To date, many attempts have been made in the art to improve the stain resistance of scoured carpets. Some approaches have involved treating the carpet with polycarboxylic acids and their conjugate bases. Thus, U.S. Pat. No. 4,937,123 (Chang et al.) describes a method for imparting stain resistance against acid colorants to polyamide fibers. In accordance with the method, the fibers are treated with an aqueous solution comprising polymethacrylic acid and copolymers thereof.

U.S. Pat. No. 5,346,726 (Pechhold) describes a polyamide fibrous substrate having deposited on it a stain resistant composition comprising a water soluble maleic anhydride/allyl ether or vinyl ether polymer.

U.S. Pat. No. 5,001,004 (Fitzgerald et al.) discloses the use of aqueous solutions of hydrolyzed ethylenically unsaturated aromatic/maleic anhydride polymers in the treatment of textiles to render them resistant to staining. Particular mention is made of the use of ammonium hydroxide as the hydrolyzing agent, although the reference notes that, when this agent is used, it is necessary to maintain the hydrolyzed polymer at an elevated temperature for an extended period of time in order to obtain satisfactory stainblocking properties on polyamide substrates.

U.S. Pat. No. 5,401,554 (Armen) discloses a process for making stain resistant melt colored carpet. In accordance with the method, a polyamide copolymer containing sulfonate groups is melt mixed with a coloring agent to form a homogenous polymer melt. The melt is spun into fibers which are tufted into a backing to form a carpet. The carpet is then treated with a compound which may be polymethacrylic acid or copolymers thereof, mixtures of polymethacrylic acid with a sulfonated aromatic formaldehyde condensation product, or a reaction product of the polymerization or copolymerization of methacrylic acid in the presence of a sulfonated aromatic formaldehyde condensation product. U.S. Pat. No. 5,436,049 (Hu) makes a similar disclosure except that, in the method described therein, the polyamide is melt mixed with a compound which is capable of reacting with the amino end groups of the polyamide so as to reduce the amino end group content thereof.

U.S. Pat. No. 3,835,071 (Allen et al.) discloses rug shampoo compositions comprising water soluble ammonium salts of styrene-maleic anhydride copolymers.

The treatment of scoured carpets with fluorochemical agents, to render them resistant to dry soil and repellent to water and oil-based stains, has been known in the art for many years. Successfully treated with these fluorochemical agents, fibrous materials, including carpets, textiles, leathers, and papers, resist the discoloration that results from normal soiling and staining and keep their original aesthetic appeal. For an overview of anti-soiling and anti-staining technology, see Mason Hayek, Waterproofing and Water/Oil Repellency, 24, Kirk-Othmer Encyclopedia of Chemical Technology, 448–55 (3d ed. 1979).

These fluorochemical agents are fluorochemical esters disclosed in U.S. Pat. No. 3,923,715 (Dettre), U.S. Pat. No. 4,029,585 (Dettre), and U.S. Pat. No. 4,264,484 (Patel) and fluorochemical urethanes and ureas disclosed in U.S. Pat. No. 3,398,182 (Guenthner et al.), U.S. Pat. No. 4,001,305 (Dear et al.) U.S. Pat. No. 4,792,354 (Matsuo et al.), and U.S. Pat. No. 5,410,073 (Kirchner). A number of other fluorochemical agents also used and described in the art include allophanate oligomers, biuret oligomers, carbodiimide oligomers, guanidine oligomers, oxazolidinone oligomers, and acrylate polymers. Commercial treatments of these various types are widely available and are sold, for example, under the "Scotchgard" and "Zonyl" trademarks.

Other attempts to improve the soil resistance of carpets have focused on the carpet manufacturing process itself. Both natural and synthetic carpet fibers contain oil residues on their surfaces at the time they are woven into the carpet. See, e.g., N. Nevrekar, B. Palan, "Spin Finishes for Synthetic Fibres—Part IV", *Man-Made Textiles In India* 331–336 (September 1991). These oil residues, which may be naturally occurring fats or waxes (in the case of wool and other natural fibers) or which may be residual spin finishes or other processing oils added during the manufacturing process (in the case of polypropylene and other synthetic fibers), significantly increase the tendency of the assembled carpet to attract dirt and other organic contaminants.

Consequently, it has become common practice in the art to "scour" carpets, a process which typically involves immersing the finished carpet in a bath of aqueous cleaning solution. The cleaning solution effectively reduces the amount of oil residue on the carpet to a level that does not significantly affect the soil resistance of the carpet. Indeed, it has long been considered essential that spin finishes be easily removable through scouring. See, P. Bajaj, R, Katre, "Spin Finishes", *Colourage* 17–26 (Nov. 16–30, 1987); W. Postman, "Spin Finishes Explained", *Textile Research Journal*, Vol. 50, No.7 444–453 (July 1980).

However, the immersion techniques involved in scouring carpets are undesirable in that they significantly increase the overall cost of manufacturing a carpet. After a carpet is scoured, it must be carefully dried in an oven or kiln to avoid warping or degradation of the carpet fibers. However, due to the immense effective surface area of a carpet, the carpet often absorbs many times its weight in water during scouring. Consequently, the drying process can be considerable, and consumes a significant amount of energy. This is especially true in the case of high quality carpets, which are usually denser than their lower quality counterparts. In the interim, the increased weight of the wetted carpets makes them very cumbersome to handle. Scouring also frequently induces static problems in the treated carpet.

There is thus a need in the art for a low wet pick-up method for imparting water and oil repellency to unscoured carpets, that is, carpets with spin-finish lubricants remaining on the fibers. In order to serve as a practical alternative to scoured carpets, carpets treated in accordance with such a method would have to exhibit soil resistance, water repellency, and/or oil repellency values comparable to, or better than, those exhibited by scoured carpets treated with similar materials.

Another problem in the art relates specifically to the use of ammonium salts of polycarboxylic acids in the treatment of carpets. To date, these materials have not found widespread acceptance as carpet treatment agents, largely because earlier work on these materials suggested that they required special handling procedures not necessitated by other carpet treatment agents. Thus, as noted previously, U.S. Pat. No. 5,001,004 (Fitzgerald et al.) teaches that it is necessary to maintain these materials at an elevated temperature for an extended period of time in order to obtain satisfactory stainblocking properties on polyamide substrates. Furthermore, these materials, like many other salts of polycarboxylic acids, were often found to exhibit poor shelf stability, rendering them undesirable for many practical applications. To date, the phenomena contributing to the poor shelf stability of salts of polycarboxylic acids, and in particular, the ammonium salts of these materials, has been poorly understood. There is thus a need in the art for salts of polycarboxylic acids, and in particular, ammonium salts of these materials, which have longer shelf lives.

These and other needs are met by the present invention, as hereinafter described.

SUMMARY OF THE INVENTION

In one aspect, the present invention relates to the use of polycarboxylate salts, such as ammonium salts of hydrolyzed styrene/maleic anhydride copolymers, as a component in soil resist treatments for unscoured carpets. The polycarboxylate salts are preferably used in combination with fluorochemical agents to impart soil resistance, water repellency, and oil repellency to unscoured carpet fibers.

In another aspect, the present invention relates to a pH-controlled method for treating carpet fibers with polycarboxylate salts. Surprisingly, it has been found that certain mixtures of polycarboxylate salts (for example, those derived from methacrylic acid) with fluorochemical agents (for example, fluorochemical adipate esters) have very good shelf stability if the pH of the mixture is kept within a certain range. Thus, for example, concentrated mixtures of fluorochemical adipates and polycarboxylate salts derived from methacrylic acid have been found to exhibit good shelf stability at a pH range of about 5 to about 6. On the other hand, it has also been discovered that these mixtures impart better repellency properties when applied at higher pHs (i.e., at pHs within the range of about 7 to about 9 for the previously noted example). Consequently, it is possible to achieve both good shelf stability and improved repellency by storing such a mixture at a first pH range within which they are stable, adjusting the pH of the mixture to a second pH range at which they impart better repellency, and applying the mixture at the second pH range.

In yet another aspect, the present invention relates to a device, such as an aerosol spray can or carpet shampoo machine, for treating a carpet substrate with a salt of a polycarboxylic acid (preferably a salt of a polymer derived from methacrylic acid). The device is equipped with a first reservoir containing a solution of the polycarboxylate salt and an optional fluorochemical agent, and a second reservoir containing a material capable of adjusting the pH of the polycarboxylate salt solution. The device is provided with mixing means for mixing appropriate portions of the polycarboxylate salt solution and the pH adjusting material so that the resulting mixture has a pH which optimizes repellency properties, and dispensing means for dispensing the mixture onto a carpet substrate.

DETAILED DESCRIPTION OF THE PREFERRED EMBODIMENT

In accordance with the present invention, a substrate (for example, a substrate comprising unscoured carpet fibers) is treated with a composition, preferably an aqueous composition, comprising a salt of a polycarboxylic acid, such as an ammonium salt of a hydrolyzed styrene/maleic anhydride copolymer. For the purposes of this invention, the term "unscoured" refers to carpet fibers having at least about 0.3 percent by weight of residual spin finish lubricant. The polycarboxylate salt is preferably used in combination with one or more fluorochemical agents to impart soil resistance, water repellency, and/or oil repellency to unscoured carpet fibers.

The composition of the present invention is preferably applied topically, and by means of a low wet pick-up method, as a spray, mist, foam, or dust. Preferably, the wet pick-up of the carpet is less than about 60% by weight, more preferably less than about 15% by weight. Where appropriate, the composition may be applied electrostatically or by such other means as are known to the art. The composition may be applied during the manufacture of the carpet substrate, during the manufacture of the carpet fibers themselves, or in the aftermarket.

One important parameter of some of the treatment compositions of the present invention is pH. Within a certain pH range, many solutions of fluorochemical agents (for example, fluorochemical adipate esters) with certain polycarboxylate salts (for example, those derived from methacrylic acid) exhibit prolonged shelf life. When the pH of these solutions falls outside of this range, shelf life is found to decrease, typically due to increased immiscibility of the polycarboxylate salt and the fluorochemical agent. On the other hand, such solutions are often found to impart increased water and/or oil repellency at pHs which fall outside of that required for solution stability. Consequently, in applications where repellency properties are desired, the solution may be provided at a pH which promotes shelf stability, and the pH of the solution may be adjusted, shortly before application of the solution to a substrate, to a second pH which is more favorable for repellency properties. Thus, for a concentrated solution of a fluorochemical adipate ester and a methacrylic acid based polycarboxylate salt, the solution may be stored and provided at a pH within the range of about 5 to about 6 to promote shelf stability, and may be adjusted to a pH of about 7 to about 9 to optimize repellency properties. Obviously, several factors, such as solution concentration and the presence of certain additives, may affect the choice of storage pH and application pH.

Various devices may be used to apply the compositions of the present invention to carpet substrates. On the manufacturing side, such devices may include, for example, spray applicators, electrostatic field generators, and foam generating devices. In aftermarket applications, the compositions may be applied, for example, from pressurized canisters as a foam or aerosol spray, or with conventional carpet treatment equipment such as carpet shampoo machines. The composition may also be incorporated as a component in shampoos, cleaners, and other carpet treatment compositions.

Where it is desirable, as in aftermarket applications, to ship or store solutions containing a fluorochemical agent and a methacrylic acid containing polymer for any appreciable length of time, the pH of the solution is preferably held within a range which promotes good shelf life. In applications where a different pH is required at the time of application (i.e., when the pH needed for optimal repellency falls outside of the range needed for shelf stability), the pH of the composition may be adjusted just prior to application. Various devices may be constructed for this purpose.

One such device is equipped with a first reservoir containing a solution of the fluorochemical agent and the polycarboxylate salt. The pH of the solution in the first reservoir is kept within a first range which promotes good solution stability. The device is also equipped with a second reservoir containing a material capable of adjusting the pH of the polycarboxylate salt solution. The device is provided with mixing means for mixing appropriate portions of the polycarboxylate salt solution and the pH adjusting material so that the resulting mixture has a pH which optimizes repellency, and dispensing means for dispensing the mixture onto a carpet substrate. Suitable mixing means are well known to the art and include, for example, a mechanical agitator disposed within a mixing chamber into which the solutions from the first and second reservoirs are introduced. The mixing means is preferably used in conjunction with a metering device, such as a pump which maintains a desired volumetric flow ratio between the solutions of the first and second reservoir as those solutions are introduced into the mixing chamber. Suitable dispensing means are also well known to the art and include, for example, pressurized nozzles or valves.

In alternate embodiments, the treating solution is formed within the device through direct adjustment of the pH of the polycarboxylate salt solution with a sufficient amount of a pH adjusting agent (i.e., ammonium hydroxide or sodium hydroxide, when the pH is to be adjusted upward) to result in a treating solution having a pH which promotes good repellency properties. In still other embodiments, the device is provided with means for adjusting the pH of the polycarboxylate salt solution after it has been applied to the carpet. An example of the latter device is a dual applicator device, wherein the first applicator applies a first solution comprising a polycarboxylic acid or polycarboxylate salt to the carpet, and the second applicator dispenses a second solution onto the carpet which adjusts the pH of the first solution to a range desirable for repellency.

While the compositions, methods, and devices of the present invention are preferably used to treat carpet fibers or carpet substrates, they may also be used to impart water or oil repellency to other substrates. Such other substrates may include, for example, textile, paper, and nonwoven substrates.

The following is a description of the polycarboxylate salts and fluorochemical agents which are useful in the compositions of the present invention, as well as a description of the carpet samples and test procedures used to evaluate the performance characteristics of these compositions in the examples.

POLYCARBOXYLATE SALTS

Generally, polycarboxylate salts useful in the present invention include ammonium and alkali metal salts of those polycarboxylic acids which have a molecular weight of at least 400 grams per mole, preferably at least 1000 grams per mole, and have an equivalent weight, measured as grams of polymer per acid equivalent, of no greater than 300 grams per equivalent, preferably no greater than 150 grams per equivalent. The polycarboxylate salts should be non-tacky solids as measured at room temperature.

Useful polycarboxylic acids include acrylic acid-containing polymers; i.e., polyacrylic acid, copolymers of acrylic acid and one or more other monomers that are copolymerizable with acrylic acid, and blends of polyacrylic acid and one or more acrylic acid-containing copolymers. These can be produced using well-known techniques for polymerizing ethylenically unsaturated monomers. Preferably, the polycarboxylic acids are methacrylic acid-containing polymers, e.g., polymethacrylic acid, copolymers of methacrylic acid and one or more other monomers that are copolymerizable with methacrylic acid, and blends of polymethacrylic acid and one or more methacrylic acid copolymers.

The polycarboxylic acid polymers useful in the invention can also be prepared using methods well-known in the art for polymerization of ethylenically unsaturated monomers. Such monomers include monocarboxylic acids, polycarboxylic acids, and anhydrides of the mono- and polycarboxylic acids; substituted and unsubstituted esters and amides of carboxylic acids and anhydrides; nitriles; vinyl monomers; vinylidene monomers; monoolefinic and polyolefinic monomers; and heterocyclic monomers. Specific representative monomers include itaconic acid, citraconic acid, aconitic acid, maleic acid, maleic anhydride, fumaric acid, crotonic acid, cinnamic acid, oleic acid, palmitic acid, and substituted or unsubstituted alkyl and cycloalkyl esters of these acids, the alkyl or cycloalkyl groups having 1 to 18 carbon atoms such as methyl, ethyl, butyl, 2-ethylhexyl, octadecyl, 2-sulfoethyl, acetoxyethyl, cyanoethyl, hydroxyethyl, β-carboxyethyl and hydroxypropyl groups. Also included are amides of the foregoing acids, such as acrylamide, methacrylamide, methylolacrylamide, 1,1-dimethylsulfoethylacrylamide, acrylonitrile, and methacrylonitrile. Various substituted and unsubstituted aromatic and aliphatic vinyl monomers may also be used; for example, styrene, α-methylstyrene, p-hydroxystyrene, chlorostyrene, sulfostyrene, vinyl alcohol, N-vinyl pyrrolidone, vinyl acetate, vinyl chloride, vinyl ethers, vinyl sulfides, vinyl toluene, butadiene, isoprene, chloroprcne, ethylene, isobutylene, and vinylidene chloride. Also useful are various sulfated natural oils such as sulfated castor oil, sulfated sperm oil, sulfated soybean oil, and sulfonated dehydrated castor oil. Particularly useful monomers include ethyl acrylate, butyl acrylate, itaconic acid, styrene, sodium sulfostyrene, and sulfated castor oil, either alone or in combination.

In the methacrylic acid-containing polymers, the methacrylic acid preferably provides about 30 to 100 weight percent, more preferably about 60 to 90 weight percent, of the polymer. The optimum proportion of methacrylic acid in the polymer depends on the comonomer(s) used, the molecular weight of the copolymer, and the pH at which the material is applied. When water-insoluble comonomers such as ethyl acrylate are copolymerized with methacrylic acid, they may comprise up to about 40 weight percent of the methacrylic acid-containing polymer. When water-soluble comonomers such as acrylic acid or sulfoethyl acrylate are copolymerized with methacrylic acid, the water soluble comonomers preferably comprise no more than 30 weight percent of the methacrylic acid-containing polymer and preferably the methacrylic acid-containing polymer also comprises up to about 50 weight percent water-insoluble monomer.

Commercially available acrylic polymers useful for making polycarboxylate salts of this invention include Carbopol™ (available from B.F. Goodrich) and the Leukotan family of materials such as Leukotan™ 970, Leukotan™ 1027, Leukotan™ 1028, and Leukotan™ QR 1083, available from Rohm and Haas Company.

Useful methacrylic acid-containing polymers for making polycarboxylate salts of this invention are also described in U.S. Pat. No. 4,937,123 (Chang et al.), U.S. Pat. No. 5,074,883 (Wang), and U.S. Pat. No. 5,212,272 (Sargent et al.).

Useful polycarboxylic acids also include hydrolyzed polymers of maleic anhydride and at least one or more ethylenically unsaturated monomers. The unsaturated monomer may be an alpha-olefin monomer or an aromatic monomer, although the latter is preferred. A variety of linear and branched chain alpha-olefins may be used including alkyl vinyl ethers. Particularly useful alpha-olefins are 1-alkenes containing 4 to 12 carbon atoms, such as isobutylene, 1-butene, 1-hexene, 1-octene, 1-decene, and 1-dodecene, with isobutylene and 1-octene being preferred, and with 1-octene being most preferred. One particularly useful alkyl vinyl ether is methyl vinyl ether. A portion of the alpha-olefins can be replaced by one or more other monomers, e.g., up to 50 wt. % of alkyl (C1–4) acrylates, alkyl (C1–4) methacrylates, vinyl sulfides, N-vinyl pyrrolidone, acrylonitrile, acrylamide, as well as mixture of the same.

A variety of ethylenically unsaturated aromatic monomers may be used to prepare the hydrolyzed polymers. The ethylenically unsaturated aromatic monomers may be represented by the general formula:

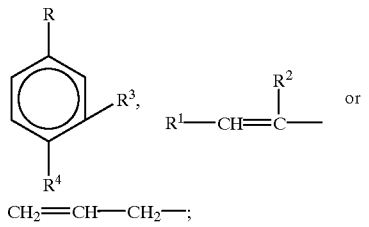

wherein R is

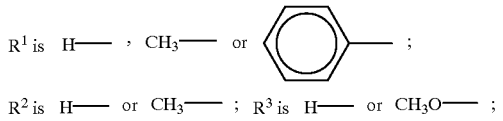

$R^4$ is H—, $CH_3$—, or

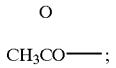

and $R^3$ plus $R^4$ is —$CH_2$—O—$CH_2$—O—$CH_2$—.

Specific examples of ethylenically unsaturated aromatic monomers include free radically polymerizable materials such as styrene, α-methylstyrene, 4-methyl styrene, stilbene, 4-acetoxystilbene (used to prepare a hydrolyzed polymer from maleic anhydride and 4-hydroxy-stilbene), eugenol, isocugenol, 4-allylphenol, safrole, mixtures of these materials, and the like. Styrene is most preferred. The utility of some of these materials may be improved by increasing the amount of polymerization initiator or acylating or etherifying the phenolic hydroxy groups.

In the hydrolyzed polymers, the ratio of units derived from ethylenically unsaturated monomer to units derived from maleic anhydride is about 0.4:1 to 1.3:1 when the unsaturated monomer is an alpha-olefin, and is about 1:1 to 2:1 when using an unsaturated aromatic monomer. In any event, a ratio of about 1:1 is most preferred.

Hydrolyzed polymers suitable for use in the invention may be prepared by hydrolyzing ethylenically unsaturated maleic anhydride polymers. Ammonia, amines, alkali metal hydroxides (such as sodium hydroxide, potassium hydroxide, and lithium hydroxide) are suitable hydrolyzing agents. Hydrolysis can be effected in the presence of more than or less than a molar amount of the alkali metal hydroxide. The hydrolyzed polycarboxylic acid copolymer may also be an acid ester, i.e., a portion of the carboxylic acid groups may be esterified with, for example, an alcohol such as ethanol, n-propanol or ethylene glycol monobutyl ether. The hydrolyzed polycarboxylic acid may also be amidated with, for example, n-butylamine, or aniline to make amic acid salt.

Commercially available maleic anhydride-containing copolymers useful for making polycarboxylate salts of this invention include styrene/maleic anhydride copolymers (e.g., the SMA series, available from Elf Atochem) and methyl vinyl ether/maleic anhydride copolymers (e.g., Gantrez™, available from ISP Corp.) Hydrolyzed polymers of at least one or more alpha-olefin monomers and maleic anhydride useful to make polycarboxylate salt-containing compositions of this invention are also described in U.S. Pat. No. 5,460,887 (Pechhold). Hydrolyzed polymers of at least one or more ethylenically unsaturated aromatic monomers and maleic anhydride useful in the compositions of this invention are also described in U.S. Pat. No. 5,001,004 (Fitzgerald et al.).

The following polycarboxylate salts are useful in the present invention.

SMA-1000: A copolymer of approximately 1600 molecular weight (number average) containing a 1:1 mole ratio of styrene:maleic anhydride, having approximately 6–8 units of each monomer, with an acid number averaging 480; commercially available from Elf Atochem, Birdsboro, Pa.

SMA-2000: A copolymer of approximately 1700 molecular weight containing a 2:1 mole ratio of styrene:maleic anhydride, having approximately 6–8 units of each monomer, with an acid number averaging 355; commercially available from Elf Atochem.

SMA-3000: A copolymer of approximately 1900 molecular weight containing a 3:1 mole ratio of styrene:malcic anhydride, having approximately 6–8 units of each monomer, with an acid number averaging 285; commercially available from Elf Atochem.

SMA-2000AA: SMA-2000 was converted to an aniline amic acid ammonium salt using the following procedure.

A vessel was charged with 174 g of tetrahydrofuran and 100 g (0.32 equivalents) of SMA-2000 while maintaining fast agitation. To the solution was slowly added 59.5 g (0.64 mol) of aniline, resulting in a slightly exothermic reaction. The reaction mixture was heated with agitation for 4 hours at 70° C. Analysis of the IR spectrum indicated that all of the anhydride had reacted to form the aniline amide/aniline salt.

The reaction mixture was then poured into a bath containing a mixture of 120 g of 10% aqueous hydrochloric acid and 1 liter of deionized water while maintaining fast agitation to precipitate the aniline amic acid, which was filtered and water-washed. The wet solid was dried in a 60° C. oven to give 133.5 g of amic acid (IR peaks at 1710, 2500–3000 and 3138 $cm^{-1}$).

To the dried amic acid was added 350 g of deionized water followed by 60 g of 28% aqueous $NH_4OH$. The mixture was heated at 50° C. until a brownish solution of the aniline amic acid ammonium salt resulted, having 16.6% (wt) solids and a pH of about 8.5.

SMA-2000BA: SMA-2000 was converted to a butylamine amic acid ammonium salt using the save procedure as described to make SMA-2000AA, except that n-butylamine was used in the same molar amount to replace aniline to give a 33.5% (wt) aqueous solution of the butylamine amic acid ammonium salt.

SMA-1440: A copolymer of approximately 2500 molecular weight, containing a 3:2 mole ratio of styrenc:maleic anhydride, having approximately 6–8 units of each monomer with each anhydride group stoichiometrically reacted with ethylene glycol monobutyl ether to give the acid ester; commercially available from Elf Atochem.

SMA-2625: A copolymer of approximately 1900 molecular weight, containing a 3:2 mole ratio of styrene:maleic anhydride, having approximately 6–8 units of each monomer with each anhydride group stoichiometrically reacted with propanol to give the acid ester; commercially available from Elf Atochem.

SMA-17352: A copolymer of approximately 1900 molecular weight, containing a 3:2 mole ratio of styrene: maleic anhydride, having approximately 6–8 units of each monomer with each anhydride group stoichiometrically reacted with phenol and isopropanol to give the acid ester; commercially available from Elf Atochem.

Gantrez™ S97: A methyl vinyl ether/maleic anhydride copolymer of approximately 70,000 molecular weight, with each anhydride group hydrolyzed with water to give the free carboxylic acid; commercially available from ISP Corp., Wayne, N.J.

Gantrez™ ES225: A copolymer containing a 1.1 mole ratio of methyl vinyl ether and maleic anhydride, of approximately 70,000 molecular weight, with each anhydride group stoichiometrically reacted with ethanol to give the acid ester; commercially available from ISP Corp.

Gantrez™ ES325: A copolymer containing a 1:1 mole ratio of methyl vinyl ether and maleic anhydride, of approximately 70,000 molecular weight, with each anhydride group stoichiometrically reacted with propanol to give the acid ester; commercially available from ISP Corp.

PMAA-$NH_4^+$: To a five liter flask equipped with air stirrer, condenser, thermometer with thermowatch, heating mantle and two adjustable dropping funnels was charged 1300 g of deionized water. The water was heated to 90° C. with air atmosphere over a period of approximately 85 minutes.

To the water was added 500 g of methacrylic acid, using the first dropping funnel. A solution consisting of 43.65 g of ammonium persulfate dissolved in 700 g of deionized water was then added using the second dropping funnel, attempting to maintain a constant 5:7 volume ratio of the addition of solutions from the first and second dropping funnels.

The resulting mixture was heated for approximately 19 hours at 90° C., then was cooled, bottled, and neutralized to a pH of 5.3 using concentrated aqueous ammonium hydroxide to give an approximately 21% (wt) solids aqueous solution of ammonium polymethacrylate.

PMAA-$K^+$: To a five liter flask equipped with air stirrer, condenser, thermometer with thermowatch, heating mantle and dropping funnel was charged 500 g of deionized water. The water was heated to 90° C. with air atmosphere. A dispersion of 500 g methacrylic acid (MAA) and 43.65 g potassium persulfate in 1500 g of deionized water was made at room temperature. The MAA/persulfate aqueous solution was added slowly into the hot water, keeping the temperature in the flask between 83° C. and 93° C.

After the addition was complete, the resulting aqueous solution was allowed to mix for an additional 10 hours between 83° C. and 93° C. using a timer set at the end of the working day. The next morning, the contents of the flask, which had cooled to 40° C., was bottled and neutralized to a pH of 5.5 using aqueous potassium hydroxide to give an approximate 21% (wt) solids aqueous solution of potassium polymethacrylate.

Polymer I: To a 1 liter reaction vessel equipped with a reflux condenser, a mechanical stirrer, and a thermometer, were charged 7.0 g of sulfated castor oil solution (70% solids) and 515.0 g of deionized water. This solution was heated to 95° C. and to this solution were added simultaneously dropwise 198.0 g of methacrylic acid, 45.2 g of butyl acrylate, and 21.6 g of ammonium persulfate in 50 g water over a period of about 2 hours. The reaction mixture was further stirred for 3 hours at 90° C. and then was cooled to 50° C. The resultant copolymer solution was partially neutralized by the addition of 25.2 g of 20% aqueous sodium hydroxide, to give a carboxylate polymer solution with 5.5 equivalents of $Na^+$ cation per 100 equivalents of carboxylate anion. The resultant product contained 33% (wt) copolymer solids.

NAA: Naphthalene acetic acid, commercially available from Mathesen Company, Inc., East Rutherford, N.J.

TPA: Terephthalic acid, commercially available from Aldrich Chemical Corp., Milwaukee, Wis.

An example of a polycarboxylate salt not useful in the present invention is Carbopol™ 691, an ultra-high molecular weight polyacrylic acid polymer consisting of 500,000 molecular weight segments crosslinked into an ultrahigh molecular weight network, commercially available from B.F. Goodrich Chemical Co., Cleveland, Ohio. The molecular weight of materials of this type causes them to be too viscous solution. Typically, the polycarboxylates used in the present invention will have a molecular weight of less than about 1 million.

FLUOROCHEMICAL AGENTS

Generally, fluorochemical agents useful in the present invention include any of the fluorochemical compounds and polymers known in the art to impart dry soil resistance and water- and oil- repellency to fibrous substrates, particularly to carpet. These fluorochemical compounds and polymers typically comprise one or more fluorochemical radicals that contain a perfluorinated carbon chain having from 3 to about 20 carbon atoms, more preferably from about 6 to about 14 carbon atoms. These fluorochemical radicals can contain straight chain, branched chain, or cyclic fluorinated alkylene groups or any combination thereof. The fluorochemical radicals are preferably free of polymerizable olefinic unsaturation but can optionally contain catenary heteroatoms such as oxygen, divalent or hexavalent sulfur, or nitrogen. Fully fluorinated radicals are preferred, but hydrogen or chlorine atoms may also be present as substituents, although, preferably, no more than one atom of either is present for every two carbon atoms. It is additionally preferred that any fluorochemical radical contain from about 40% to about 80% fluorine by weight, and more preferably, from about 50% to about 78% fluorine by weight. The terminal portion of the radical is preferably fully fluorinated, preferably containing at least 7 fluorine atoms, e.g., $CF_3CF_2CF_2$—, $(CF_3)_2CF$—, $SF_5CF_2$—. Perfluorinated aliphatic groups (i.e., those of the formula $C_nF_{2n+1}$—) are the most preferred fluorochemical radical embodiments.

Representative fluorochemical compounds useful in treatments of the present invention include fluorochemical urethanes, ureas, esters, ethers, alcohols, epoxides, allophanates, amides, amines (and salts thereof), acids (and salts thereof), carbodiimides, guanidines, oxazolidinones, isocyanurates, and biurets. Blends of these compounds are also considered useful. Representative fluorochemical polymers useful in treatments in the present invention include fluorochemical acrylate and substituted acrylate homopolymers or copolymers containing fluorochemical acrylate and substituted acrylate monomers interpolymerized with monomers free of non-vinylic fluorine such as methyl methacrylate, butyl acrylate, acrylate and methacrylate esters of oxyalkylene and polyoxyalkylene glycol oligomers (e.g., oxyethylene glycol dimethacrylate, polyoxyethylene glycol dimethacrylate, polyoxyethylene glycol acrylate, and methoxypolyoxyethylene glycol acrylate), glycidyl methacrylate, ethylene, butadiene, styrene, isoprene, chloroprene, vinyl acetate, vinyl chloride, vinylidene chloride, vinylidene fluoride, acrylonitrile, vinyl chloroacetate, vinylpyridine, vinyl alkyl ethers, vinyl alkyl ketones, acrylic acid, methacrylic acid, 2-hydroxyethylacrylate, acrylamide, N-methylolacrylamide, 2-(N,N,N-trimethylammonium)ethyl methacrylate, and 2-acrylamido-2-methylpropanesulfonic acid (AMPS). The relative amounts of various non-vinylic fluorine-free comonomers used are generally selected empirically depending on the fibrous substrate to be treated, the properties desired, and the mode of application onto the fibrous substrate. Useful fluorochemical agents also include blends of the various fluorochemical polymers described above as well as blends of the aforementioned fluorochemical compounds with these fluorochemical polymers.

Also useful in the present invention as substrate treatments are blends of these fluorochemical agents with fluorine-free extender compounds, such as free-radically polymerized polymers and copolymers made from methyl methacrylate, butyl acrylate, lauryl acrylate, octadecyl methacrylate, acrylate and methacrylate esters of oxyalkylene and polyoxyalkylene polyol oligomers, glycidyl methacrylate, 2-hydroxyethylacrylate, N-methylolacrylamide, and 2-(N,N,N-trimethylammonium) ethyl methacrylate; siloxanes; urethanes, such as blocked isocyanate-containing polymers and oligomers; condensates or precondensates of urea or melamine with formaldehyde; glyoxal resins; condensates of fatty acids with melamine or urea derivatives; condensation of fatty acids with polyamides and their epichlorohydrin adducts; waxes; polyethylene; chlorinated polyethylene; and alkyl ketene dimers. Blends of these fluorine-free extender polymers and compounds are also considered useful in the present invention. The relative amount of the extender polymers and compounds in the treatment is not critical to the present invention. However, the overall composition of the substrate treatment should contain, relative to the amounts of solids present in the system, at least 3 weight percent, and preferably at least about 5 weight percent, of carbon-bound fluorine in the form of said fluorochemical radical groups. Many treatments, including treatment blends that include fluorine-free extender polymers and compounds such as those described above, are commercially available as ready-made formulations. Such products are sold, for example, as Scotchgard™ brand Carpet Protector manufactured by 3M, and as Zonyl™ brand carpet treatment manufactured by E.I. du Pont de Nemours and Company.

The following are specific fluorochemical agents which are useful in the present invention.

FC-1355: Scotchgard™ Commercial Carpet Protector FC-1355, an aqueous fluorochemical ester emulsion containing approximately 45% (wt) solids, commercially available from 3M Company, St. Paul, Minn.

FC-1373: Scotchgard™ Commercial Carpet Protector FC-1373, an aqueous fluorochemical urethane emulsion containing approximately 30% (wt) solids, commercially available from 3M Company.

FC-A: A fluorochemical adipate ester as described in U. S. Pat. No. 4,264,484, Example 8, formula XVII. The ester was used as a 34% (wt) solids emulsion.

FC-B: A fluoroaliphatic acrylate copolymer was prepared using the following procedure.

Into a one-quart (0.9 L), narrow-mouth amber bottle was charged 140 g of $C_8F_{17}SO_2N(CH_3)C_2H_4OC(O)CH{=}CH_2$, 60 g of n-butyl acrylate, 0.4 g of n-octylmercaptan, 328 g of deionized water, 140 g of acetone, 18 g of Tergitol™ 15-S-30 surfactant (commercially available from Union Carbide Corp.), Vazo™ V-50 initiator [2,2'-azobis(2-amidopropane) hydrochloride] (commercially available from Wako Chemicals USA Inc.), and 0.4 g of Ageflex™ Q-6 surfactant (commercially available from CPS Chemicals, West Memphis, Ark.).

The contents in the bottle were degassed three times using a vacuum, breaking the vacuum each time with nitrogen gas. The bottle was sealed and was placed in a 70° C. laundrometer for 15.3 hours. The bottle was then opened and the contents were stripped of acetone with a rotary evaporation to give a 43% (wt) solids aqueous emulsion of fluorochemical acrylic copolymer.

CARPETS

The method of the present invention may be used to treat a wide variety of carpet materials, including polypropylene, nylon, acrylic, and wool carpets. The treatment of the following specific carpets is illustrated in the Examples.

Regal Heir™ Carpet—a polypropylene carpet, Style 17196, available from Shaw Industries, Inc., Dalton, Ga. The unscoured carpet contains approximately 0.66% (wt) of lubricant on the fibers and is characterized by a Berber style and a face weight of 49 oz/yd$^2$ (1.7 kg/m$^2$). The scoured carpet contains approximately 0.13% (wt) of lubricant on the fibers. The color of the carpet is sand dollar and is designated by the color code 96100.

Chesapeake Bay™ Carpet—a polypropylene carpet, Style 53176, commercially available from Shaw Industries, Inc. The unscoured carpet contains approximately 0.89% (wt) of lubricant on the fibers and is characterized by a 100% cut pile style and a face weight of 52 oz/yd$^2$ (1.8 kg/m$^2$). The scoured carpet contains approximately 0.18% (wt) of lubricant on the fibers. The color of the carpet is Vellum and is designated by the color code 76113.

Ultima™ II 053 Nylon Carpet—a solution-dyed nylon carpet, commercially available from Diamond Carpet Mill, Eton, Ga. The fiber is made from nylon 6 polymer available from BASF Corp., Parsippany, N.J. The unscoured carpet contains approximately 1.6% (wt) of lubricant on the fibers and is characterized by a 100% cut pile style and a face weight of 50 oz/yd$^2$ (1.7 kg/m$^2$). The color of the carpet is Soft Pebble and is designated by the color code 101.

Nylon 6 Greige Goods Carpet—a nylon carpet, available from Horizon Industries, Division of Mohawk Carpet, Atlanta, Ga. The fiber is made from nylon 6 polymer available from BASF Corp., Parsippany, N.J. The carpet has not been dyed and is similar to solution-dyed nylon carpet without color pigment. The unscoured carpet contains approximately 0.8% (wt) of lubricant on the fibers and is characterized by a 100% cut and loop style and a face weight of 28 oz/yd$^2$ (1.0 kg/m$^2$).

TEST PROCEDURES

The following procedures were used in the Examples of the present invention:

Determining Percent Lubricant on Carpet Fibers—The weight percent of lubricant on unscoured or scoured carpet fibers was determined in accordance with the following test procedure.

A 9.3 g carpet sample is placed in an 8 oz (225 mL,) glass jar along with 80 g of solvent (typically, ethyl acetate or methanol). The glass jar is capped and is mounted on a tumbler for 10 minutes. Next, 50 g of the solvent containing the stripped lubricant is poured into a tared aluminum pan which is placed in a 250° F. (121° C.) vented oven for 20 minutes to remove the solvent. The pan is then reweighed to determine the amount of lubricant present. The percent lubricant on the carpet is calculated by dividing the weight of lubricant by the initial weight of the carpet sample and multiplying by 100.

Scouring of Carpet—Scouring of the carpet to remove lubricant can be accomplished by washing the carpet thoroughly with hot water containing detergent, followed by rinsing.

Spray Application and Curing Procedure—The aqueous treatment is applied to the carpet via spraying to about 15% by weight wet pickup. The amount of polycarboxylate salt and fluorochemical agent to be added to the aqueous treatment solution is determined by the theoretical percent solids on fiber (expressed as "% SOF") desired. Unless specified otherwise, the wet sprayed carpet is then dried at 120° C. until dry (typically 10–20 minutes) in a forced air oven to cure the treatment onto the carpet.

Foam Application and Curing Procedure—The foamer used in the present invention consists of a foam preparation device and a vacuum frame device.

The foam preparation device is a Hobart Kitchen-Aid™ mixer made by the Kitchen-Aid Division of Hobart Corporation, Troy, Ohio.

The vacuum frame device is a small stainless steel bench with a vacuum plenum and a vacuum bed. The carpet to be treated is placed on the bed, along with the foamed material to be deposited onto the carpet. The vacuum bed forms a bench that has an exhaust port fitted to a Dayton Tradesman™ 25 gallon Heavy Duty Shop Vac. The size of the bed is 8"×12"×1.5" (20 cm×30 cm×4 cm). The plenum is separated from the rest of the bed by an aluminum plate in which closely spaced 1/16" (1.7 mm) holes are drilled. The plate is similar in structure to a colander.

The portion of carpet to be treated is weighed. The carpet may then be pre-wetted with water. Several parameters of the application must be adjusted by trial and error. In particular, trial foams must be prepared in order to determine the blow ratio, which is determined by the equation $$\text{blow ratio}=\text{foam volume}/\text{foam weight}$$

In general, the foam should be adjusted so that the wet pick-up of foam is about 60% that of the dry carpet weight. A doctor blade can be prepared out of any thin, stiff material. Thin vinyl sheeting, approximately 100 mil (2.5 mm) thick, is especially suitable, since it can be cut easily to any size. The notch part of the blade should be about 8" (20 cm) wide so as to fit into the slot of the vacuum bed.

In a typical application, about 150 g of liquid to be foamed is put into the bowl of the Kitchen-Aid™ mixer. The wire whisk attachment is used and the mixer is set to its highest speed (10). About 2–3 minutes are allowed for the foam to form and stabilize at a certain blow ratio. The blow ratio may be calculated by placing volume marks on the side of the bowl.

An excess of the foam is placed on top of the carpet specimen resting flat on the vacuum bed. Caution must be exercised so that there are no large air pockets in the foam structure. The foam is then doctored off with the doctor blade. The vacuum is then subsequently turned on and pulled into the carpet. At this point, the carpet may be oven dried.

"Walk-On" Soiling Test—The relative resistance of the treated carpet to dry soiling is determined by challenging both treated unscoured and untreated unscoured (control) carpet under defined "walk-on" soiling conditions and comparing their relative soiling levels. The defined soil condition test is conducted by mounting treated and control small square carpet samples on particle board panels (typically five to seven replicates of each), placing the panels on the floor at a high pedestrian location, and allowing the samples to be soiled by normal foot traffic. The amount of foot traffic in each of these areas is monitored, and the position of each sample within a given location is changed daily using a pattern designed to minimize the effects of position and orientation upon soiling.

Following a period of one cycle of walk-on traffic followed by vacuuming, where one cycle is defined as approximately 10,000 foot-traffics, soiled carpet samples are removed and the amount of soil present on a given sample is determined using colorimetric measurements, making the assumption that the amount of soil on a given sample is directly proportional to the difference in color between the unsoiled sample and the corresponding sample after soiling. The three CIE L*a*b* color coordinates of the soiled carpet samples are measured using a Minolta 310 Chroma Meter with a D65 illumination source. The color difference value, ΔE, of each soiled carpet sample is calculated relative to its unsoiled counterpart (i.e., carpet which has not been walked upon) using the equation $$\Delta E=[(\Delta L^*)^2+(\Delta a^*)^2+(\Delta b^*)^2]^{1/2}$$

where $\Delta L^*=L^*\text{soiled(treated)}-L^*\text{unsoiled(control)}$ $\Delta a^*=a^*\text{soiled(treated)}-a^*\text{unsoiled(control)}$ $\Delta b^*=b^*\text{soiled(treated)}-b^*\text{unsoiled(control)}$ The ΔE values calculated from these colorimetric measurements have been shown to be qualitatively in agreement with values from older, visual evaluations such as the soiling evaluation suggested by the American Associates of Textile Chemists and Colorists (AATCC), and have the additional advantages of higher precision and being unaffected by environment variations or operator subjectivities. Typical, the 95% confidence interval when using five to seven replicates is about ±1 ΔE unit.

A ΔΔE value is also calculated, which is a "relative ΔE" value obtained by subtracting from the ΔE value of the soiled treated unscoured carpet sample the ΔE value measured for a soiled untreated unscoured carpet sample. The lower the ΔΔE value, the better the soil resistance of the treatment. A negative ΔΔE value means that the treated unscoured carpet is more resistant to soiling than is untreated unscoured carpet.

Oil Repency Test—Treated carpet samples were evaluated for oil repellency using 3M Oil Repellency Test III (February 1994), available from 3M (based on AATCC Test Method 118–1983). In this test, treated carpet samples are challenged to penetration by oil or oil mixtures of varying surface tensions. The oil repellency of the treated carpet is described using the following 100 point scale:

| Oil Repellency Rating | Oil Composition |
|---|---|
| 0 | (fails mineral oil) |
| 15 | mineral oil ("Kaydol") |
| 30 | 85/15 (vol) mineral oil |
| 45 | 65/35 (vol) mineral oil with n-hexadecane |
| 60 | n-hexadecane |
| 75 | n-tetradecane |
| 90 | n-dodecane |
| 100 | n-decane |

In running this test, a treated carpet sample approximately 8 in by 8 in (20 cm×20 cm) is placed on a flat, horizontal surface and the carpet pile is hand-brushed in the direction giving the greatest lay to the yarn. Five small drops of an oil or oil mixture are gently placed from a height of ⅛ in (3 mm) at points at least 2 in (5 cm) apart on the carpet sample, without touching the carpet with the dropper tip. If, after observing for ten seconds at a 45° angle, four of the five drops are visible as a sphere or a hemisphere, the carpet is deemed to pass the test for that oil or oil mixture. The reported oil repellency rating corresponds to the most penetrating oil (i.e., the highest numbered oil in the above table) for which the treated carpet sample passes the described test. Intermediate ratings (e.g., 35 or 40) indicate that the oil repellency falls between values listed for particular oil compositions.

Water Repellency Test—Treated carpet samples were evaluated for water repellency using 3M Water Repellency Test V for Floor coverings (February 1994), available from 3M. In this test, treated carpet samples are challenged to penetrations by blends of deionized water and isopropyl alcohol (IPA). Each blend is assigned a rating as shown below, using a similar 100 point scale as used to report oil repellency:

| Water Repellency Rating | Water/IPA Blend (% by volume) |
|---|---|
| 0 | (fails water) |
| 15 | 100% water |
| 30 | 90/10 water/IPA |
| 45 | 80/20 water/IPA |
| 60 | 70/30 water/IPA |
| 75 | 60/40 water/IPA |
| 90 | 50/50 water/IPA |
| 100 | 40/60 water/IPA |

The Water Repellency Test is run in the same manner as is the Oil Repellency Test, with the reported water repellency rating corresponding to the highest IPA-containing blend for which the treated carpet sample passes the test. Intermediate ratings indicate that the water repellency falls between values listed for particular water and IPA/water blends.

EXAMPLES

Example 1

In Example 1, the ammonium salt of SMA-1000 was made using the following procedure. Into a reaction flask charged with 510 g of deionized water was slowly added, with agitation, 150 g of SMA-1000. Next, 83 g of concentrated (28%) aqueous ammonium hydroxide (a slight stoichiometric excess) was added, resulting in a slightly exothermic reaction. The reaction mixture was stirred for 2 hours at 70° C. to yield a clean aqueous solution with a pH of 8.3 and containing 22.7% (wt) solids.

The SMA-1000 ammonium polycarboxylate salt solution was then dispersed in water in combination with FC-1355 fluorochemical agent, and the treating solution was topically applied to and cured on unscoured Regal Heir™ or unscoured Chesapeake Bay™ polypropylene carpet using the Spray Application and Oven Curing Procedure, at a theoretical polycarboxylate salt level of 0.56% solids on fiber (SOF) and a theoretical fluorine level of 350 ppm (FOF).

The treated Regal Heir™ carpet was evaluated for water repellency using the Water Repellency Test and oil repellency using the Oil Repellency Test, and the treated Chesapeake Bay carpet was evaluated for anti-soiling using one cycle of the "Walk-On" Soiling Test. Results from these evaluations are presented in Table 1.

Examples 2–5

In Examples 2–5, the same carpet treatment, curing and evaluation procedures were used on unscoured Regal Heir™ and Chesapeake Bay™ polypropylene carpets as described in Example 1, except that the SMA-1000 was neutralized with a slight stoichiometric excess of methylamine, n-butylamine, triethylamine and triethanolamine, respectively, to a pH of approximately 8.

Results from these evaluations are presented in Table 1.

Comparative Examples C1 and C2

In Comparative Examples C1 and C2, the same carpet treatment, curing and evaluation procedures were done on unscoured Regal Heir™ and Chesapeake Bay™ polypropylene carpets as described in Example 1, except that the SMA-1000 was neutralized with a slight stoichiometric excess of tetramethylammonium hydroxide and sodium hydroxide, respectively, to a pH of approximately 8.

Results from these evaluations are presented in Table 1.

Example 6 and Comparative Example C3

In Example 6 and Comparative Example C3, the same carpet treatment, curing and evaluation procedures were done on unscoured Regal Heir™ and Chesapeake Bay™ polypropylene carpets as described in Examples 1 and Comparative Example C2, respectively, except that no fluorochemical agent was incorporated in the carpet treating solution.

Results are presented in Table 1.

Comparative Example C4

In Comparative Example C4, the same carpet treatment, curing and evaluation procedures were done on unscoured Regal Heir™ and Chesapeake Bay™ polypropylene carpets as described in Example 1, except that no polycarboxylate salt was incorporated in the carpet treating solution.

Results are presented in Table 1.

Comparative Example C5

In Comparative Example C5, no treatment was applied to scoured Regal Heir™ and Chesapeake Bay™ polypropylene carpets. The scoured Regal Heir™ carpet was evaluated for water and oil repellency, and the scoured Chesapeake Bay™ carpet was evaluated for anti-soiling using the same evaluation procedures as described in Example 1.

Results are presented in Table 1.

TABLE 1

| Ex. | Counter Ion | Fluoro-chemical | Water Repellency | Oil Repellency | Soiling (ΔΔE) |
|---|---|---|---|---|---|
| 1 | $NH_4^+$ | FC-1355 | 100 | 60 | −4.7 |
| 2 | $CH_3NH_3^+$ | FC-1355 | 100 | 75 | −3.8 |
| 3 | $C_4H_9NH_3^+$ | FC-1355 | 100 | 75 | −3.2 |
| 4 | $(C_2H_5)_3NH^+$ | FC-1355 | 30 | 60 | −4.9 |
| 5 | $(HOC_2H_4)_3NH^+$ | FC-1355 | 0 | 60 | −2.5 |
| C1 | $(CH_3)_4N^+$ | FC-1355 | 0 | 60 | −2.5 |
| C2 | $Na^+$ | FC-1355 | 0 | 75 | −4.9 |
| 6 | $NH_4^+$ | — | 15 | 0 | −3.4 |
| C3 | $Na^+$ | — | 0 | 0 | −3.1 |

TABLE 1-continued

| Ex. | Counter Ion | Fluoro-chemical | Water Repellency | Oil Repellency | Soiling (ΔΔE) |
|---|---|---|---|---|---|
| C4 | --- (no salt) | FC-1355 | 10 | 75 | −0.8 |
| C5 | --- (no salt; carpet scoured) | — | 15 | 0 | −3.1 |

The data in Table 1 show that the polycarboxylate salts with the simple ammonium cation ($NH_4^+$) (Example 1), the small methylammonium cation (Example 2), and the slightly larger butylammonium cation (Example 3) gave the best combination of water and oil repellency and anti-soiling properties to the unscoured carpets when compared to untreated scoured polypropylene (Comparative Example C5). The somewhat larger triethylammonium cation gave excellent anti-soiling performance (Example 4) but exhibited a lower water repellency. Polycarboxylate salts with low-volatility triethanolammonium, cation (Example 5) and the non-volatile tetramethylammonium and sodium cations (Comparative Examples C1 and C2, respectively) gave poor water repellency.

When ammonium polycarboxylate salt but no fluorochemical agent was present (Example 6), water repellency but no oil repellency was noted, and anti-soiling performance was inferior to when the fluorochemical agent was present (Example 1).

Example 1, containing the ammonium salt of SMA-1000, is presented again for comparison.

Results are presented in Table 2.

Comparative Example C6

In Comparative Example C6, the same carpet treatment, curing and evaluation procedures were done on unscoured Regal Heir™ and Chesapeake Bay™ polypropylene carpets as described in Example 10, except that the sodium salt of SMA-1000 was substituted for the ammonium salt.

Results are present in Table 2.

Comparative Example C7

In Comparative Example C7, the same carpet treatment, curing and evaluation procedures were done on unscoured Regal Heir™ and Chesapeake Bay™ polypropylene carpets as described in Examples 10 and Comparative Example C6, respectively, except that no ammonium SMA-1000 salt was incorporated in the carpet treating solution.

Examples 6 and Comparative Example C3, containing the ammonium and sodium salts respectively of SMA-1000 and no fluorochemical agent, are presented again for comparison.

Results are presented in Table 2.

TABLE 2

| | Polycarboxylate Salt: | | | | Fluorochemical: | | Water | Oil | Soiling |
|---|---|---|---|---|---|---|---|---|---|
| Ex. | Name | Molecular Wt. of SMA | Cation | % SOF | Name | ppm FOF | Repellency | Repellency | (ΔΔE) |
| 7 | SMA-1000 | 1600 | $NH_4^+$ | 0.75 | FC-1355 | 375 | 30 | 65 | −4.1 |
| 8 | SMA-2000 | 1700 | $NH_4^+$ | 0.75 | FC-1355 | 375 | 30 | 45 | −4.5 |
| 9 | SMA-3000 | 1900 | $NH_4^+$ | 0.75 | FC-1355 | 375 | 30 | 60 | −3.7 |
| 10 | SMA-1000 | 1600 | $NH_4^+$ | 0.56 | FC-A | 350 | 75 | 75 | −3.8 |
| C6 | SMA-1000 | 1600 | $Na^+$ | 0.56 | FC-A | 350 | 0 | 100 | −3.2 |
| 1 | SMA-1000 | 1600 | $NH_4^+$ | 0.56 | FC-1355 | 350 | 100 | 60 | −4.7 |
| 6 | SMA-1000 | 1600 | $NH_4^+$ | 0.56 | — | — | 15 | 0 | −3.4 |
| C3 | SMA-1000 | 1600 | $Na^+$ | 0.56 | — | — | 0 | 0 | −3.1 |
| C7 | — | — | — | — | FC-A | 350 | 10 | 100 | −0.6 |

When sodium polycarboxylate salt but no fluorochemical agent was present (Comparative Example C3), no water or oil repellency was evident.

When fluorochemical agent but no ammonium polycarboxylate salt was present (Comparative Example C4), a sacrifice in both water repellency and soil resistance was noted, though good oil repellency was evident.

Examples 7–10

In Examples 7–10, unscoured Regal Heir™ and Chesapeake Bay™ polypropylene carpets were treated, cured and evaluated as described in Example 1, except this time the molecular weight of the SMA resins was varied and two different fluorochemical agents, FC-1355 and FC-A esters, were evaluated.

In Examples 7, 8 and 9, carpets were treated at 0.75% SOF of SMA-1000, SMA-2000 and SMA-3000 ammonium salts, respectively, and 375 ppm FOF of FC-1355. The ammonium salts of SMA-2000 and SMA-3000 were made using the method described in Example 1.

In Example 10, carpets were treated at 0.56% SOF of the ammonium salt of SMA-1000 and 350 ppm FOF of FC-1355.

The data in Table 2 show that the SMA-1000 with ammonium countercation again out performed the SMA-1000 with sodium countercation in providing water repellency to the carpet (Example 10 vs. Comparative Example C6), as was noted with FC-1355 in Table 1. Overall, a better combination of water and oil repellency and soil resistance was achieved using a mixture of ammonium polycarboxylate salt with fluorochemical agent (Example 10) than when either ingredient was used alone (Example 6 or Comparative Example C7).

In all examples, a significant improvement in the soil repellency of treated carpet vs. untreated carpet was observed.

Comparative Examples C8 and C9

In Comparative Examples C8 and C9, unscoured Regal Heir™ and Chesapeake Bay™ polypropylene carpets were treated, cured and evaluated as described in Example 1, except this time ammonium salts of low molecular weight monocarboxylic acids (terephthalic and naphthalene acetic acids respectively) were evaluated at 0.56% SOF in combination with FC-1355 fluorochemical agent at 350 ppm FOF.

Example 1, containing the ammonium salt of SMA-1000, is shown again for comparison.

Results are presented in Table 3.

Comparative Examples C10 and C11

In Comparative Examples C10 and C11, the same carpet treatment, curing and evaluation procedures were done on unscoured Regal Heir™ and Chesapeake Bay™ polypropylene carpets as described in Comparative Examples C8 and C9 respectively, except that the fluorochemical repellent was omitted from each carpet treating solution and only the ammonium carboxylate salts were incorporated and evaluated.

Example 6, containing the ammonium salt of SMA-1000 and no fluorochemical agent, is shown again for comparison.

Results are presented in Table 3.

Examples 11–15

In Examples 11–15, unscoured Regal Heir™ and Chesapeake Bay™ polypropylene carpets were treated, cured and evaluated as described in Example 1. Ammonium salts of amides (Examples 11 and 12) and esters (Examples 13–15) of various styrene/maleic anhydride copolymers were evaluated in combination with FC-1355 fluorochemical agent. In Examples 11–13, the ammonium salts were applied at 0.56% SOF and the FC-1355 at 350 ppm FOF. In Examples 14 and 15, the ammonium salts were applied at 0.75% SOF and the FC-1355 at 375 ppm FOF.

Results are presented in Table 3.

TABLE 3

| | Polycarboxylate Salt: | | | Fluorochemical Agent: | | Water | Oil | Soiling |
|---|---|---|---|---|---|---|---|---|
| Ex. | Name | % SOF | M.W. | Name | ppm FOF | Repellency | Repellency | (ΔΔE) |
| C8 | TPA | 0.56 | 200 | FC-1355 | 350 | 30 | 45 | −2.7 |
| C9 | NAA | 0.56 | 179 | FC-1355 | 350 | 10 | 45 | +2.9 |
| 1 | SMA-1000 | 0.56 | 1600 | FC-1355 | 350 | 100 | 60 | −4.7 |
| C10 | TPA | 0.56 | 200 | — | — | 0 | 0 | +0.3 |
| C11 | NAA | 0.56 | 179 | — | — | 0 | 0 | +7.1 |
| 6 | SMA-1000 | 0.56 | 1600 | — | — | 15 | 0 | −3.4 |
| 11 | SMA-2000AA | 0.56 | 1800 | FC-1355 | 350 | 45 | 75 | −3.5 |
| 12 | SMA-2000BA | 0.56 | 1800 | FC-1355 | 350 | 60 | 75 | −4.4 |
| 13 | SMA-1440 | 0.56 | 2500 | FC-1355 | 350 | 30 | 60 | −2.1 |
| 14 | SMA-2625 | 0.75 | 1900 | FC-1355 | 375 | 75 | 65 | −2.6 |
| 15 | SMA-17352 | 0.75 | 1900 | FC-1355 | 375 | 100 | 65 | −3.4 |

The data in Table 3 show that ammonium salts of low molecular weight monocarboxylic acids do not perform well at imparting either water repellency or anti-soiling performance to the unscoured carpet. Without fluorochemical agent, the treated unscoured carpets also showed poor oil repellency.

The data in Table 3 also show that all of the combinations of FC-1355 fluorochemical agent with ammonium polycarboxylate salts having various compositions and molecular weights exhibited a combination of good water repellency, oil repellency and anti-soiling performance.

Examples 16–17

In Examples 16–17, unseoured Regal Heir™ and Chesapeake Bay™ polypropylene carpets were treated, cured and evaluated as described in Example 1, except this time the treating solution contained ammonium salts of methyl vinyl ether/maleic anhydride copolymer acid esters, both in combination with FC-A fluorochemical ester agent. The ammonium polycarboxylate salts were each applied at 0.56% SOF and the fluorochemical agent FC-A, at 350 ppm FOF.

The ammonium salts of Examples 16 and 17 were prepared according to the procedure given in Example 1, and each aqueous solution had a pH of between about 8 and 9.

Results are presented in Table 4.

TABLE 4

| Ex. | Polycarboxylate Salt: | Mol. Wt. of Salt | Counterion | Fluoro-chemical | Water Repel. | Oil Repel. | Soiling (ΔΔE) |
|---|---|---|---|---|---|---|---|
| 16 | Gantrez ™ ES225 | 70,000 | $NH_4^+$ | FC-A | 90 | 90 | −4.2 |
| 17 | Gantrez ™ ES325 | 70,000 | $NH_4^+$ | FC-A | 100 | 75 | −3.8 |

The data in Table 4 show that when a combination of an ammonium salt of a methyl vinyl ether/maleic anhydride copolymer acid ester having a relatively high molecular weight (about 70,000) and a fluorochemical agent was topically applied to unscoured polypropylene carpet, the treated carpet exhibited a combination of excellent water and oil repellency and good soil resistance.

Examples 18–22

In Examples 18–20, unscoured Regal Heir™ (RH) and Chesapeake Bay™ (CB) polypropylene carpets and Ultima II™ (UII) solution-dyed nylon carpet were treated, cured and evaluated as described in Example 1, except this time the treating solution contained the ammonium salt of polymethacrylic acid (PMAA-$NH_4^+$) in combination with FC-1355 fluorochemical ester agent, applied at 0.56% SOF and 350 ppm FOF, respectively.

In Examples 21 and 22, the same procedure was used as in Examples 18–20. except that fluorochemical urethane agent FC-1373 was substituted for FC-1355 and the Ultima II™ solution-dyed nylon carpet was not run.

Results are presented in Table 5.

Comparative Examples C12–C16

In Comparative Example C12–C16, the same procedure was followed as in Examples 18–22, respectively, except that the potassium salt of polymethacrylic acid (PMAA-$K^+$) was used in place of the ammonium salt.

Results are presented in Table 5.

TABLE 5

| Ex. | Carpet | Polycarboxylate Salt | Counterion | Fluoro-chemical | Water Repel. | Oil Repel. | Soiling (ΔΔE) |
|---|---|---|---|---|---|---|---|
| 18 | RH | PMAA | $NH_4^+$ | FC-1355 | 45 | 75 | N/R |
| C12 | RH | PMAA | $K^+$ | FC-1355 | 15 | 75 | N/R |
| 19 | CB | PMAA | $NH_4^+$ | FC-1355 | 15 | 20 | −6.3 |
| C13 | CB | PMAA | $K^+$ | FC-1355 | 0 | 5 | −6.4 |
| 20 | UII | PMAA | $NH_4^+$ | FC-1355 | 15 | 30 | −8.1 |
| C14 | UII | PMAA | $K^+$ | FC-1355 | 15 | 30 | −8.4 |
| 21 | RH | PMAA | $NH_4^+$ | FC-1373 | 45 | 75 | N/R |
| C15 | RH | PMAA | $K^+$ | FC-1373 | 0 | 75 | N/R |
| 22 | CB | PMAA | $NH_4^+$ | FC-1373 | 15 | 5 | −5.6 |
| C16 | CB | PMAA | $K^+$ | FC-1373 | 0 | 5 | −5.0 |

The data in Table 5 show overall improved water repellency using the ammonium salt compared to the potassium salt of polymethacrylic acid.

Examples 23–27

In Examples 23–27, exactly the same carpet treatments (i.e., varying the ammonium countercation), curing and evaluations were run as described in Examples 1–5 except that unscoured Ultima™ II solution-dyed nylon carpet was used for all the testing. Treatment application was at 0.56% SOF of polycarboxylate salt and 350 ppm FOF of FC-1355 fluorochemical agent.

Results are presented in Table 6.

Comparative Examples C17 and C18

In Comparative Examples C17 and C18, the same treatment, curing and evaluation procedures were run on unscoured Ultimar™ II solution-dyed nylon carpet as described in Example 23, except that the SMA-1000 was neutralized with tetramethylammonium hydroxide and sodium hydroxide, respectively.

Results from these evaluations are presented in Table 6.

Example 28 and Comparative Example C19

In Example 28 and Comparative Example C19, the same carpet treatment, curing and evaluation procedures on Ultima™ solution-dyed nylon carpet were run as described in Example 23 and Comparative Example C18, respectively, except that no fluorochemical repellent was incorporated in the carpet treating solution.

Results are presented in Table 6.

Comparative Example C20

In Comparative Example C20, the same carpet treating, curing and evaluating procedures on unscoured Ultima™ II solution-dyed nylon carpet were run as described in Examples 23–27, except that no polycarboxylate salt was incorporated in the carpet treating solution.

Results are presented in Table 6.

Comparative Example C21

In Comparative Example C21, unscoured and untreated Ultima™ II solution-dyed nylon carpet was evaluated as described in Examples 23–27.

Results are presented in Table 6.

TABLE 6

| Ex. | Counter Ion | Fluoro-chemical | Water Repel-lency | Oil Repellency | Soiling (ΔΔE) |
|---|---|---|---|---|---|
| 23 | $NH_4^+$ | FC-1355 | 30 | 30 | −6.1 |
| 24 | $CH_3NH_3^+$ | FC-1355 | 45 | 60 | −6.7 |
| 25 | $C_4H_9NH_3^+$ | FC-1355 | 45 | 45 | −5.4 |
| 26 | $(C_2H_5)_3NH^+$ | FC-1355 | 15 | 30 | −5.4 |
| 27 | $(HOC_2H_4)_3NH^+$ | FC-1355 | 30 | 15 | −6.6 |
| C17 | $(CH_3)_4N^+$ | FC-1355 | 0 | 45 | −4.4 |
| C18 | $Na^+$ | FC-1355 | 0 | 30 | −5.1 |
| 28 | $NH_4^+$ | — | 0 | 0 | −2.6 |
| C19 | $Na^+$ | — | 0 | 0 | −2.0 |
| C20 | --- (no salt) | FC-1355 | 30 | 45 | −4.9 |
| C21 | --- (no salt) | — | 0 | 0 | 0 |

The data in Table 6 show that the polycarboxylate salts with small protonated ammonium cations ($CH_3NH_3^+$ in Example 24 and $C_4H_9NH_3^+$ in Example 25) imparted the best combination of water repellency and anti-soiling to unscoured carpets. The polycarboxylate salts containing countercations which could not unblock ($(CH_3)_4N^+$ in Comparative Example C17 and $Na^+$ in comparative Example C18) gave the poorest water repellency. Improved anti-soiling was generally noted when the combination of ammonium polycarboxylate salt and fluorochemical agent was used as compared to when each ingredient was used alone (Example 23 vs. Example 28 and Comparative Example C20).

Examples 29, 31 and 33

In Examples 29, 31 and 33, samples of unscoured Regal Heir™ polypropylene carpet, unscoured Chesapeake Bay™ polypropylene carpet, and Ultima II™ solution-dyed nylon carpet respectively were cotreated with aqueous solutions of Polymer I and FC-1355, at 0.425% SOF each using the Spray Application and Oven Curing Procedure. Before formulating the Polymer I solution was neutralized to a pH of 5.5 with aqueous concentrated ammonium hydroxide to give a total of about 29.5% acid groups neutralized (including the 5.5% acid groups already neutralized by sodium hydroxide in Polymer I). Treated carpets were evaluated for water repellency using the Water Repellency Test and oil repellency using the Oil Repellency Test, and treated Chesapeake Bay carpets were evaluated for anti-soiling using one cycle of the "Walk-On" Soiling Test.

Results are presented in Table 7.

Examples 30, 32 and 34

In Examples 30, 32, and 34, the same experiments were run as in Examples 29, 31 and 33, respectively, except that Polymer I alone was applied at 0.85% SOF.

Results are presented in Table 7.

Comparative Examples C22, C24 and C26

In Comparative Examples C22, C24 and C65, the same experiment was run as in Examples 29, 31 and 33, respectively, except that FC-1355 alone was applied at 0.85% SOF.

Results are presented in Table 7.

Comparative Examples C23, C25 and C27

In Comparative Examples C23, C25 and C27, the unscoured respective carpets were left untreated and were evaluated as described in Examples 29, 31 and 33.

Results are presented in Table 7.

TABLE 7

| Ex. | Carpet | Polymer I: % SOF | FC-1355: % SOF | Water Repel-lency | Oil Repel-lency | Soiling (ΔΔE) |
|---|---|---|---|---|---|---|
| 29 | Regal Heir ™ | 0.425 | 0.425 | 35 | 20 | −4.62 |
| 30 | Regal Heir ™ | 0.85 | — | 5 | 0 | −3.18 |
| C22 | Regal Heir ™ | — | 0.85 | 5 | 5 | −3.06 |
| C23 | Regal Heir ™ | — | — | 0 | 0 | 0 |
| 31 | Chesapeake Bay ™ | 0.425 | 0.425 | 15 | 5 | −4.59 |
| 32 | Chesapeake Bay ™ | 0.85 | — | 0 | 0 | −4.14 |
| C24 | Chesapeake Bay ™ | — | 0.85 | 0 | 15 | −2.04 |
| C25 | Chesapeake Bay ™ | — | — | 0 | 0 | 0 |
| 33 | Ultima II ™ | 0.425 | 0.425 | 45 | 50 | −8.43 |
| 34 | Ultima II ™ | 0.85 | — | 0 | 0 | −3.63 |
| C26 | Ultima II ™ | — | 0.85 | 60 | 60 | −7.31 |
| C27 | Ultima II ™ | — | — | 0 | 0 | 0 |

The data in Table 7 show that, for each of the three carpets, the blend of Polymer I and FC-1355 produced better anti-soiling properties than either Polymer I or FC-1355 contributed alone at a comparable SOF level, thus demonstrating a true and unexpected synergy.

Examples 35–36 and Comparative Examples C28–C29

In Examples 35–36 and Comparative Examples C28–C29, a comparison of performance was made after applying a combination of an ammonium polycarboxylate salt and a fluorochemical agent to scoured and unscoured polypropylene carpets.

In Example 35, the ammonium salt of SMA-1000 (made as described in Example 1 and having an aqueous solution pH of 8.3) at 0.75% SOF and FC-1355 at 375 ppm FOF were coapplied to unscoured Regal Heir™ and Chesapeake Bay™ polypropylene carpets using the Spray Application and Oven Curing Procedure. Treated Regal Heir™ carpet was evaluated for water repellency using the Water Repellency Test and oil repellency using the Oil Repellency Test, and treated Chesapeake Bay™ carpet was evaluated for anti-soiling using one cycle of the "Walk-On" Soiling Test.

In Example 36, the same experiment was run as in Example 35 except the ammonium salt of Polymer I (made as described in Example 29) was substituted for the ammonium salt of SMA.

Results are printed in Table 8.

Comparative Examples C28 and C29

In Comparative Examples C28 and C29, the same experiments were run as described in Examples 35 and 36 respectively, except that scoured rather than unscoured Regal Heir™ and Chesapeake Bay™ polypropylene carpets were used.

Results are printed in Table 8.

All ΔΔE soiling data presented in Table 8 is calculated relative to untreated scoured carpet rather than unscoured carpet.

TABLE 8

| Ex. | Carpet Scoured? | Poly-carboxy-late Salt | Fluorochem. Agent | Water Repel. | Oil Repel. | Soiling (ΔΔE) |
|---|---|---|---|---|---|---|
| 35 | No | SMA-1000 | FC-1355 | 45 | 75 | −0.26 |
| C28 | Yes | SMA-1000 | FC-1355 | 30 | 45 | −0.56 |
| 36 | No | Polymer I | FC-1355 | 30 | 30 | −0.37 |
| C29 | Yes | Polymer I | FC-1355 | 30 | 20 | −0.74 |

The data in Table 8 show that the combination of FC-1355 fluorochemical repellent with the ammonium salt of either SMA-1000 or Polymer I actually improves the water and oil repellency of unscoured carpet to the point where it is comparable to that of treated scoured carpet. Soil resistance of treated unscoured carpet was comparable to that of treated scoured carpet.

Examples 37–42

In Examples 37–42, fluorochemical acrylic polymer agent FC-B in combination with ammonium polycarboxylate salts was evaluated as a treatment for various unscoured carpets.

In Examples 37–39, the ammonium salt of SMA-1000, prepared as described in Example 1, was coapplied at 0.56% SOF with FC-B at 350 ppm FOF to unscoured Regal Heir™ (RH) polypropylene carpet, unscoured Chesapeake Bay™ (CB) polypropylene carpet, and Ultima™ II 053 (UII) solution-dyed nylon carpet, respectively, using the Spray Application and Curing Procedure. Treated carpets were evaluated for repellency using the Water and Oil Repellency Tests and for soil resistance using one cycle of the "Walk-On" Soiling Test.

In Examples 40–42, the same carpet treating, curing and evaluating procedures were run as described in Examples 37–39, respectively, except that instead of the ammonium salt of SMA-1000, the ammonium salt of Polymer I, prepared as described in Example 29 with an aqueous solution pH of 5.5, was used.

Results are presented in Table 9.

TABLE 9

| Ex. | Carpet | Polycarboxylate Salt | Counterion | Mol. Wt. | Water Repel. | Oil Repel. | Soiling (ΔΔE) |
|---|---|---|---|---|---|---|---|
| 37 | RH | SMA-1000 | $NH_4^+$ | 1600 | 100 | 45 | N/R |
| 38 | CB | SMA-1000 | $NH_4^+$ | 1600 | 45 | 50 | −6.1 |
| 39 | UII | SMA-1000 | $NH_4^+$ | 1600 | 45 | 5 | −6.2 |
| 40 | RH | Polymer I | $NH_4^+$,$Na^+$ | 16000 | 75 | 30 | N/R |
| 41 | CB | Polymer I | $NH_4^+$,$Na^+$ | 16000 | 0 | 45 | −5.9 |
| 42 | UII | Polymer I | $NH_4^+$,$Na^+$ | 16000 | 30 | 0 | −3.9 |

The data in Table 9 show that, in general, good water and oil repellencies and anti-soiling performance were achieved, especially with the combination of SMA-1000 ammonium salt and the fluorochemical acrylic polymer agent FC-B.

Example 43–45 and Comparative Examples C30–C32

In Example 43–45 and Comparative Examples C30–C32, the utility of using foam application to apply to various unscoured carpets a treatment containing an ammonium polycarboxylate salt and a fluorochemical agent is shown.

In Examples 43–45, the ammonium salt of SMA-1000, prepared as described in Example 1, was coapplied at approximately 0.97% SOF with fluorochemical ester agent FC-1355 at approximately 385 ppm FOF to unscoured Regal Heir™ (RH) polypropylene carpet, unscoured Chesapeake Bay (CB) propylene carpet and Ultima™ II (UII) solution-dyed nylon carpet, respectively, using the Foam Application and Curing Procedure at a blow ratio of 20:1. The foaming agent used was Witconate™ AOS (an α-olefin sulfonate commercially available from Witco Corp., Houston, Tx.), at a level of 0.14% product on carpet (POC). Treated carpets were evaluated for repellency using the Water and Oil Repellency Tests and for anti-soiling using one cycle of the "Walk-On" Soiling Test.

In Comparative Examples C30–C32, the same carpet foam treating, curing and evaluating procedures were run as described in Examples 43–45, respectively, except that the sodium salt of SMA-1000, prepared as described in Comparative Example C2, was used instead of the ammonium salt.

Results are presented in Table 10.

TABLE 10

| Ex | Carpet | Polycarboxylate Salt | Counterion | Water Repellency | Oil Repellency | Soiling (ΔEE) |
|---|---|---|---|---|---|---|
| 43 | RH | SMA-1000 | $NH_4^+$ | 90 | 75 | N/R |
| 44 | CB | SMA-1000 | $NH_4^+$ | 45 | 45 | −9.2 |
| 45 | UII | SMA-1000 | $NH_4^+$ | 15 | 75 | −13.3 |
| C30 | RH | SMA-1000 | $Na^+$ | 30 | 90 | N/R |
| C31 | CB | SMA-1000 | $Na^+$ | 0 | 45 | −10.1 |
| C32 | UII | SMA-1000 | $Na^+$ | 0 | 75 | −13.5 |

The data in Table 10 show that the ammonium salt of SMA-1000 consistently imparted superior water repellency to the carpets when compared to the sodium salt of SMA-1000. Thus, topical foam application can be used instead of topical spray application to apply a combination of ammonium polycarboxylate salt and fluorochemical agent to unscoured carpet to impart water repellency.

Examples 46–51 and Comparative Examples C33–C41

In Examples 46–51 and Comparative Examples C33–C41, carpets were topically treated by compositions of this invention, the compositions were cured on the carpets at ambient conditions (i.e., at room temperature), and repellency and soil resistance of the treated carpets were measured.

In Examples 46–47, the ammonium salt of SMA-1000 (prepared as described in Example 1) was coapplied at 0.75% SOF with fluorochemical ester agent FC-1355 at 375 ppm FOF to unscoured Regal Heir™ (RH) polypropylene carpet and unscoured Nylon Greige Goods (NGG) nylon 6 carpet, respectively. The Spray Application and Curing Procedure was used except that the treatment was allowed to dry and cure overnight at room temperature (instead of baking in a forced air oven). Treated carpets were evaluated for repellency using the Water and Oil Repellency Tests and for anti-soiling using one cycle of the "Walk-On" Soiling Test.

In Comparative Example C33, the same treating, room temperature curing and evaluating procedures were run as in Example 46 except that the Regal Heir™ carpet was scoured prior to treatment. In this case, ΔΔE soiling results are reported in reference to scoured untreated carpet.

In Comparative Examples C34–C36, the same carpet treating, room temperature curing and evaluating procedures were run as described in Examples 46–47 and Comparative Example C33, respectively, except that the sodium salt of SMA-1000 (prepared as described in Comparative Example C2) was used instead of the ammonium salt.

In Examples 48–49 and Comparative Example C37, the same treating, room temperature curing and evaluating procedures were run as described in Examples 46–47 and Comparative Example C33, respectively, except that Polymer I neutralized to a pH of 5.5 with $NH_4OH$ (prepared as described in Example 29) was used instead of the ammonium salt of SMA-1000.

In Examples 50–51 and Comparative Example C38, the same treating, room temperature curing and evaluating procedures were run as described in Examples 48–49 and Comparative Example C37, respectively, except that Polymer I was not partially neutralized with $NH_4OH$ from a pH of 4 to a pH of 5.5 but rather was neutralized with $NH_4OH$ all the way from the parent acid (pH of 3.4) up to a pH of 5.5.

In Comparative Examples C39–C41, the same treating, room temperature curing and evaluating procedures were run as described in Examples 48–49 and Comparative Example C37, respectively, except that Polymer I was used as is (i.e., at a pH of 4.0) with no further neutralization by $NH_4OH$ or NaOH.

Results from Examples 46–51 and Comparative Examples C33–C41 are presented in Table 11.

TABLE 11

| Ex. | Carpet | Polycarboxylate Salt | Counterion | pH of Salt | Water Repel. | Oil Repel. | Soiling (ΔΔE) |
|---|---|---|---|---|---|---|---|
| 46 | RH (uns) | SMA-1000 | $NH_4^+$ | 8.3 | 10 | 20 | −2.9 |
| 47 | NGG | SMA-1000 | $NH_4^+$ | 8.3 | 10 | 20 | −9.5 |
| C33 | RH (sc) | SMA-1000 | $NH_4^+$ | 8.3 | 10 | 10 | −0.6* |
| C34 | RH (uns) | SMA-1000 | $Na^+$ | 8 | 0 | 15 | −3.6 |
| C35 | NGG | SMA-1000 | $Na^+$ | 8 | 0 | 50 | −9.0 |
| C36 | RH (sc) | SMA-1000 | $Na^+$ | 8 | 10 | 30 | −1.2* |
| 48 | RH (uns) | Polymer I | $NH_4^+$,$Na^+$ | 5.5 | 0 | 15 | −3.0 |
| 49 | NGG | Polymer I | $NH_4^+$,$Na^+$ | 5.5 | 10 | 10 | −9.7 |
| C37 | RH (sc) | Polymer I | $NH_4^+$,$Na^+$ | 5.5 | 10 | 10 | −0.4* |
| 50 | RH (uns) | Polymer I | $NH_4^+$ | 5.5 | 20 | 20 | −3.0 |
| 51 | NGG | Polymer I | $NH_4^+$ | 5.5 | 20 | 15 | −9.6 |
| C38 | RH (sc) | Polymer I | $NH_4^+$ | 5.5 | 30 | 20 | −0.5* |
| C39 | RH (uns) | Polymer I | $NH_4^+/Na^+$ | 4.0 | 0 | 0 | −3.0 |
| C40 | NGG | Polymer I | $NH_4^+/Na^+$ | 4.0 | 0 | 0 | −10.8 |
| C41 | RH (sc) | Polymer I | $NH_4^+/Na^+$ | 4.0 | 0 | 0 | −0.2* |

*ΔΔE values referenced to scoured untreated carpet.

The date in Table 11 show that, even when cured under ambient conditions, combinations of ammonium salts of SMA-1000 or Polymer I polycarboxylate with fluorochemical ester agent FC-1355 imparted a combination of water repellency, oil repellency and soil resistance to a variety of unseoured carpets. Regarding water repellency, the ammonium polycarboxylate salts outperformed their sodium counterparts. Also notable is the improvement in both water and oil repellency going from unneutralized Polymer I which is 5.5% preneutralized with NaOH (Comparative Examples C39–C41) to Polymer I neutralized with $NH_4OH$ (Examples 48–49 and further improvement going to Polymer I neutralized only with $NH_4OH$ and not preneutralized with NaOH (Examples 50–51).

A further observation is that, in the case of Regal Heir™ carpet, the enhancement in anti-soiling performance was far more dramatic with unscoured carpet as compared to scoured carpet.

Examples 52–53 and Comparative Example C42

In Examples 52–53 and Comparative Example C42, Polymer I was further neutralized with ammonium hydroxide, was coapplied with fluorochemical ester agent FC-1355 to unscoured Regal Heir™ and Chesapeake Bay™ polypropylene carpets, was oven cured, and the resulting carpet repellency and soil resistance were measured.

In Example 52, the same treating, curing and evaluating procedures were run as described in Example 1, except that instead of the ammonium salt of SMA-1000, the ammonium salt of Polymer I, prepared as described in Example 29, was used. Concentrations used for application were 0.75% SOF for the Polymer I ammonium salt and 375 ppm FOF for the fluorochemical ester agent FC-1355.

In Example 53, the same treating, curing and evaluating procedures were run as described in Example 52, except that the Polymer I all-ammonium salt (preparation described in Example 50) was used instead of the Polymer I salt containing mixed ammonium and sodium cations.

In Comparative Example C42, the same treating, curing and evaluating procedures were run as described in Example 52, except that Polymer I was used as is (i.e., at a pH of 4 with no further neutralization).

Results from Examples 52–53 and Comparative Example C42 are presented in Table 12.

TABLE 12

| Ex. | Poly-carboxylate Salt | Counterion | Salt pH | Water Repel-lency | Oil Repel-lency | Soiling (ΔΔE) |
|---|---|---|---|---|---|---|
| 52 | Polymer I | Na+,$NH_4^+$ | 5.5 | 30 | 50 | −7.8 |
| 53 | Polymer I | $NH_4^+$ | 5.5 | 30 | 45 | −8.1 |
| C42 | Polymer I | $Na^+$ | 4.0 | 15 | 10 | −6.7 |

The data in Table 12 show that the formulations containing Polymer I neutralized with ammonium hydroxide (Example 52) or a combination of ammonium and sodium hydroxide (Example 53) give superior repellency and soil resistance to unscoured carpets as compared when Polymer I was neutralized to a pH of 4 only with sodium hydroxide (Comparative Example C42).

Examples 54–59 and Comparative Examples C43–C45

In Examples 54–59 and Comparative Examples C43–C45, the effect of neutralizing Polymer I to various pHs with ammonium hydroxide on carpet repellency and anti-soiling properties was determined.

Polymer I was made according to the procedure previously described in the glossary except that neutralization with sodium hydroxide was omitted; the resulting aqueous unneutralized polycarboxylate dispersion had a pH of 3.4. Part of this low pH dispersion was adjusted to a pH of 5.5 with ammonium hydroxide. Another part of this low pH dispersion was adjusted to a pH of 9.0 with ammonium hydroxide. Using the Spray Application and Curing Procedure, FC-1355 at 350 ppm FOF was coapplied to either Regal Heir™ (RH), Chesapeake Bay™ (CB) or Ultima™ II (UII) carpet with each pH version of Polymer I at 0.56% SOF. The Water Repellency Test, the Oil Repellency Test and one cycle of the "Walk-On" Soiling Test was run in each case except with Regal Heir™ carpet, where only water and oil repellency were measured.

Results from Examples 54–59 and Comparative Examples C43–C45 are presented in Table 13.

TABLE 13

| Ex. | Carpet | Polycarboxylate Salt | pH of Salt | Water Repellency | Oil Repellency | Soiling (ΔΔE) |
|---|---|---|---|---|---|---|
| 54 | RH | Polymer I | 9 | 60 | 90 | N/R |
| 55 | CB | Polymer I | 5.5 | 45 | 60 | N/R |
| C43 | UII | Polymer I | 3.4 | 15 | 5 | N/R |
| 56 | RH | Polymer I | 9 | 35 | 45 | −7.9 |
| 57 | CB | Polymer I | 5.5 | 30 | 30 | −7.0 |
| C44 | UII | Polymer I | 3.4 | 0 | 0 | −6.4 |
| 58 | RH | Polymer I | 9 | 60 | 60 | −9.0 |
| 59 | CB | Polymer I | 5.5 | 30 | 45 | −8.8 |
| C45 | UII | Polymer I | 3.4 | 15 | 5 | −10.1 |

The data in Table 13 show that both water and oil repellency improved with increasing pH of the ammonium polycarboxylate salt, with the pH 5.5 salt performing better than the unneutralized pH 3.4 acid, and the pH 9 salt performing better than the pH 5.5 salt. Anti-soiling performance was good in all cases.

Examples 60–74 and Comparative Examples C46–C51

In Examples 60–74 and Comparative Examples C46–C5 1, a study was made of the effect of pH and extent of neutralization on repellency and antisoiling properties of unscoured carpet treated with a blend of Polymer I and FC-1355.

Using the Spray Application and Curing Procedure, Polymer I at 0.56% SOF and FC-1355 at 350 PPM FOF were coapplied to either Regal Heir™ (RH), Chesapeake Bay™ (CB) or Ultima™ II (UII) carpet at various pHs, ranging from 3.5 (unneutralized Polymer I) to 9.3 (neutralizing with either $NH_4OH$ or NaOH). The Water Repellency Test, the Oil Repellency Test and the "Walk-On" Soiling Test was run in each case, with results presented in Table 14.

TABLE 14

| | | Polymer I | | | | | |
|---|---|---|---|---|---|---|---|
| Ex. | Carpet | pH Solution | Neutralizer | % Mole | Water Repel. | Oil Repel | Soiling (ΔΔE) VS untreated |
| C46 | RH | 3.5 | None | — | 10 | 5 | N/R |
| 60 | RH | 5.5 | $NH_4OH$ | 0.18 | 40 | 65 | N/R |
| 61 | RH | 9 | $NH_4OH$ | 0.54 | 50 | 80 | N/R |
| 62 | RH | 5.1 | NaOH | 0.18 | 25 | 60 | N/R |
| 63 | RH | 6.1 | NaOH | 0.54 | 50 | 90 | N/R |
| 64 | RH | 9.3 | NaOH | 0.85 | 25 | 75 | N/R |
| C47 | CB | 3.5 | None | — | 0 | 5 | −6.6 |
| 65 | CB | 5.5 | $NH_4OH$ | 0.18 | 35 | 30 | −7.1 |
| 66 | CB | 9.0 | $NH_4OH$ | 0.54 | 35 | 40 | −7.5 |
| 67 | CB | 5.1 | NaOH | 0.18 | 0 | 10 | −7.3 |
| 68 | CB | 6.1 | NaOH | 0.54 | 10 | 20 | −7.1 |
| 69 | CB | 9.3 | NaOH | 0.85 | 10 | 10 | −6.4 |
| C48 | UII | 3.5 | None | — | 10 | 5 | −9.1 |
| 70 | UII | 5.5 | $NH_4OH$ | 0.18 | 25 | 55 | −8.2 |
| 71 | UII | 9.0 | $NH_4OH$ | 0.54 | 60 | 55 | −8.6 |
| 72 | UII | 5.1 | NaOH | 0.18 | 10 | 30 | −9.3 |
| 73 | UII | 6.1 | NaOH | 0.54 | 45 | 55 | −8.3 |
| 74 | UII | 9.3 | NaOH | 0.85 | 55 | 75 | −8.3 |
| C49 | RH | (Unscoured, Untreated) | | | 0 | 0 | N/R |
| C50 | CB | (Unscoured, Untreated) | | | 0 | 0 | N/R |
| C51 | UII | (Unscoured, Untreated) | | | 0 | 0 | N/R |

The data in Table 14 show several trends. First of all, water and oil repellency imparted to each carpet by Polymer I improved with increasing pH, whether neutralized with ammonium or sodium hydroxide, with best repellencies achieved when pH was at least 5.5. Secondly, unneutralized Polymer I imparted lower repellencies but outperformed unscoured, untreated carpet for each carpet.

Thirdly, repellency imparted to Regal Heir™ (polypropylene, Berber style) and Ultima™ II (solution-dyed nylon, cut pile style) carpets was superior to repellency imparted to Chesapeake Bay™ (polypropylene, cut pile style) carpet, especially using the sodium salt of Polymer I.

The preceding description is meant to convey an understanding of the present invention to one skilled in the art, and is not intended to be limiting. Modifications within the scope of the invention will be readily apparent to those skilled in the art. Therefore, the scope of the invention should be construed solely by reference to the appended claims.

What is claimed is:

1. A method for treating carpet, comprising the steps of:

providing a substrate comprising unscoured carpet fibers; and applying to the substrate a composition comprising a fluorochemical and the reaction product of a polycarboxylic acid with a mixture of ammonium hydroxide and an alkali metal hydroxide.

2. The method of claim 1, wherein the composition is an aqueous dispersion.

3. The method of claim 1, wherein the composition is applied topically.

4. The method of claim 1, further comprising the step of:

curing the composition with the application of heat.

5. The method of claim 1, wherein the carpet fibers comprise polypropylene.

6. The method of claim 1, wherein the composition has a pH of at least about 5.5.

7. The method of claim 1, wherein the polycarboxylic acid is a polyacrylate.

8. The method of claim 1, wherein said polycarboxylic acid is a copolymer of maleic anhydride and at least one ethylenically unsaturated monomer.

9. The method of claim 8, wherein said ethylenically unsaturated monomer is an alkyl vinyl ether.

10. The method of claim 9, wherein said alkyl vinyl ether is methyl vinyl ether.

11. The method of claim 8, wherein said ethylenically unsaturated monomer is an α-olefin.

12. The method of claim 11, wherein said α-olefin is an alkene containing 4 to 12 carbon atoms.

13. The method of claim 12, wherein said α-olefin is selected from the group consisting of isobutylene, 1-butene, 1-hexene, 1-octene, 1-decene, and 1-dodecene.

14. The method of claim 8 wherein said ethylenically unsaturated monomer is styrene.

15. A method for treating carpet, comprising the steps of:

providing a substrate comprising unscoured carpet fibers;

providing a polycarboxylic acid;

at least partially neutralizing the polycarboxylic acid with a base;

forming a composition comprising the partially neutralized polycarboxylic acid and a fluorochemical; and applying the composition to the substrate, said method providing the unscoured carpet with soil resistance, water repellency and/or oil repellency which is comparable to or exceeds that of scoured fibers treated with the same materials.

16. The method of claim 15, wherein the composition is applied topically.

17. The method of claim 15, wherein the base is sodium hydroxide.

18. The method of claim 15, wherein the base is a mixture of sodium hydroxide and ammonium hydroxide.

19. The method of claim 15, further comprising the step of:

curing the composition with the application of heat.

20. The method of claim 15, wherein the carpet fibers comprise polypropylene.

21. The method of claim 15, wherein the composition has a pH of at least about 5.5.

22. The method of claim 15, wherein the composition has a pH of at least about 6.

23. The method of claim 15, wherein said polycarboxylate is a copolymer of maleic anhydride and at least one ethylenically unsaturated monomer.

24. The method of claim 23, wherein said ethylenically unsaturated monomer is an alkyl vinyl ether.

25. The method of claim 24, wherein said alkyl vinyl ether is methyl vinyl ether.

26. The method of claim 23, wherein said ethylenically unsaturated monomer is an α-olefin.

27. The method of claim 26, wherein said α-olefin is an alkene containing 4 to 12 carbon atoms.

28. The method of claim 27, wherein said α-olefin is selected from the group consisting of isobutylene, 1-butene, 1-hexene, 1-octene, 1-decene, and 1-dodecene.

29. The method of claim 28, wherein said α-olefin is 1-octene.

30. A method for treating carpet, comprising the steps of:

providing a substrate comprising unscoured carpet fibers;

providing an aqueous dispersion comprising a fluorochemical and the reaction product of a polycarboxylic acid with ammonium hydroxide and an alkali metal hydroxide, said dispersion having a pH of at least about 5;

topically applying the dispersion to the substrate with a wet pick-up of less than about 60%; and curing the dispersion onto the substrate with the application of heat.

31. The method of claim 30, wherein the reaction product is formed by reacting the polycarboxylic acid with a mixture of ammonium hydroxide and an alkali metal hydroxide.

32. The method of claim 30, wherein the carpet fibers comprise polypropylene.

33. The method of claim 30, wherein the polycarboxylic acid is a polyacrylate.

34. The method of claim 30, wherein said polycarboxylic acid is a copolymer of maleic anhydride and at least one ethylenically unsaturated monomer.

35. The method of claim 34, wherein said ethylenically unsaturated monomer is an alkyl vinyl ether.

36. The method of claim 35, wherein said alkyl vinyl ether is methyl vinyl ether.

37. The method of claim 30, wherein said ethylenically unsaturated monomer is an α-olefin.

38. The method of claim 37, wherein said α-olefin is an alkene containing 4 to 12 carbon atoms.

39. The method of claim 37, wherein said α-olefin is selected from the group consisting of isobutylene, 1-butene, 1-hexene, 1-octene, 1-decene, and 1-dodecene.

40. The method of claim 34 wherein said ethylenically unsaturated monomer is styrene.

41. A method for treating carpet, comprising the steps of:

providing a substrate comprising unscoured carpet fibers; and applying to the substrate an aqueous composition comprising a fluorochemical and the reaction product of a polycarboxylic acid with a base; wherein the aqueous composition has a pH of at least about 5.5, said method providing the unscoured carpet with soil resistance, water repellency and/or oil repellency which is comparable to or exceeds that of scoured fibers treated with the same materials.

42. The method of claim 41, wherein the base is selected from the group consisting of ammonium hydroxide and alkali metal hydroxides.

43. The method of claim 41, wherein the base is ammonium hydroxide.

44. The method of claim 41, wherein the base is a mixture of ammonium hydroxide and sodium hydroxide.

45. The method of claim 41, wherein the aqueous composition has a pH of at least about 6.

46. The method of claim 41, wherein the aqueous composition has a pH of at least about 9.

47. The method of claim 41, wherein the polycarboxylic acid is a polyacrylate.

48. The method of claim 41, wherein the aqueous composition is applied topically with a wet pick-up of less than about 60%.

49. The method of claim 41, wherein said polycarboxylate is a copolymer of maleic anhydride and at least one ethylenically unsaturated monomer.

50. The method of claim 49, wherein said ethylenically unsaturated monomer is an α-olefin.

51. The method of claim 49, wherein said α-olefin is an alkene containing 4 to 12 carbon atoms.

52. The method of claim 51, wherein said α-olefin is selected from the group consisting of isobutylene, 1-butene, 1-hexene, 1-octene, 1-decene, and 1-dodecene.

53. The method of claim 52, wherein said α-olefin is 1-octene.

54. The method of claim 49, wherein said ethylenically unsaturated monomer is an alkyl vinyl ether.

55. The method of claim 54, wherein said alkyl vinyl ether is methyl vinyl ether.

56. The method of claim 41, further comprising the step of:

curing the composition with the application of heat.

57. The method of claim 41, said carpet fibers comprise polypropylene.

* * * * *